US005970565A

United States Patent [19]

Dubner

[11] Patent Number: 5,970,565

[45] Date of Patent: Oct. 26, 1999

[54] BETWEEN TOES DRYER

[76] Inventor: Ben B. Dubner, 84 Marcus Ave., New Hyde Park, L.I., N.Y. 11040

[21] Appl. No.: 08/966,679

[22] Filed: Nov. 10, 1997

Related U.S. Application Data

[63] Continuation-in-part of application No. 08/867,569, Jun. 2, 1997, abandoned.

[51] Int. Cl.[6] ..... A47K 10/00

[52] U.S. Cl. ..... 15/210.1; 15/233; 604/1

[58] Field of Search ..... 15/209.1, 210.1, 15/233; 604/1, 2, 3

[56] References Cited

U.S. PATENT DOCUMENTS

| | | | |
|---|---|---|---|
| 576,211 | 2/1897 | Martin | 15/210.1 |
| 748,367 | 12/1903 | Haight | 15/210.1 |
| 814,203 | 3/1906 | Haight | 15/210.1 |
| 1,371,790 | 3/1921 | Kelly | 15/210.1 |
| 1,637,595 | 8/1927 | Sturgis | 15/233 |
| 2,893,031 | 7/1959 | Dengler | 15/210.1 |
| 2,893,039 | 7/1959 | Szlachertka | 15/210.1 |
| 3,203,418 | 8/1965 | Johnston | 604/1 |
| 3,458,887 | 8/1969 | Radack | 15/210.1 |
| 4,314,426 | 2/1982 | Friend | 15/210.1 |
| 4,457,756 | 7/1984 | Kern et al. | 604/1 |
| 4,827,556 | 5/1989 | Coresetti | 15/210.1 |
| 4,940,454 | 7/1990 | Siragusa | 604/1 |
| 5,435,039 | 7/1995 | Taylor | 15/210.1 |

*Primary Examiner*—Mark Spisich
*Assistant Examiner*—Theresa T. Snider
*Attorney, Agent, or Firm*—Bauer & Schaffer, LLP

[57] ABSTRACT

An apparatus to expedite washing, drying and treatment of the skin between toes, having two resilient flexible arms attached to a handle, with sleeves of appropriate materials that can be easily secured on said apparatus.

9 Claims, 1 Drawing Sheet

Fig. 1
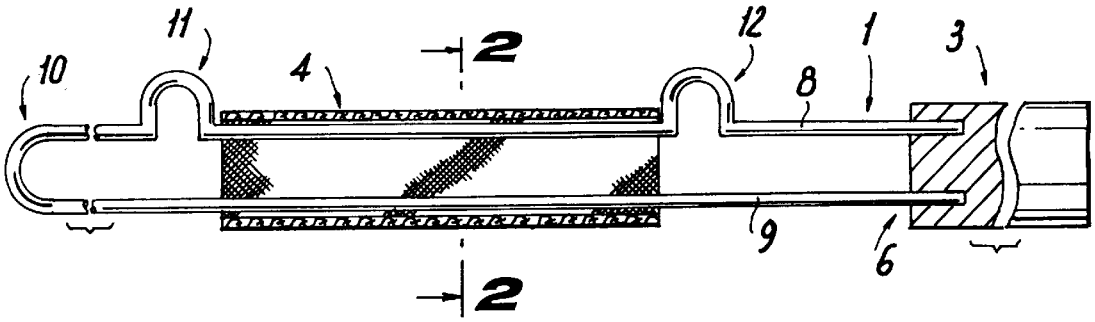
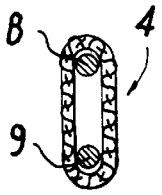
Fig. 2
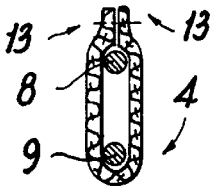
Fig. 3
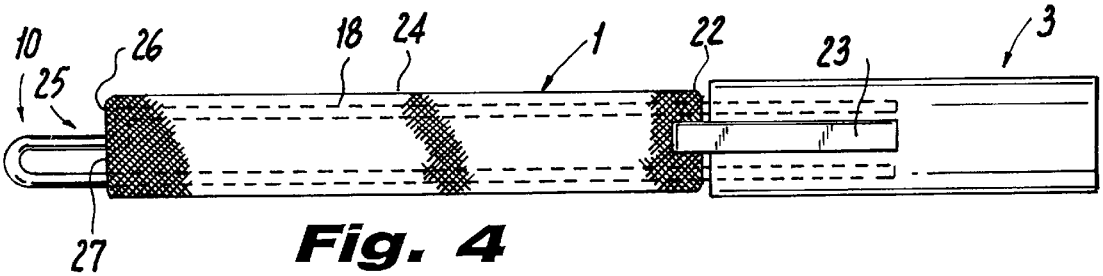
Fig. 4
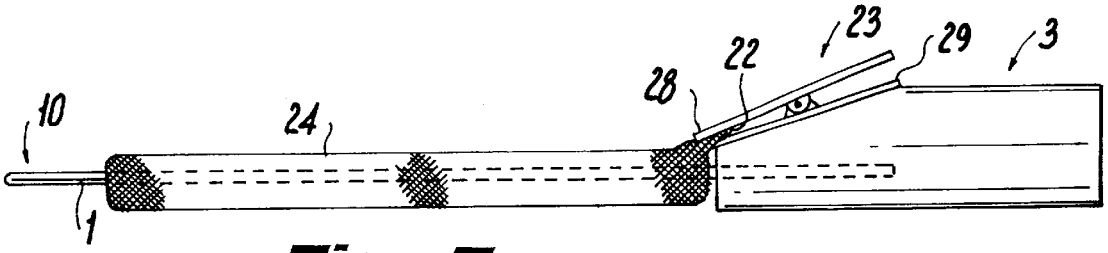
Fig. 5
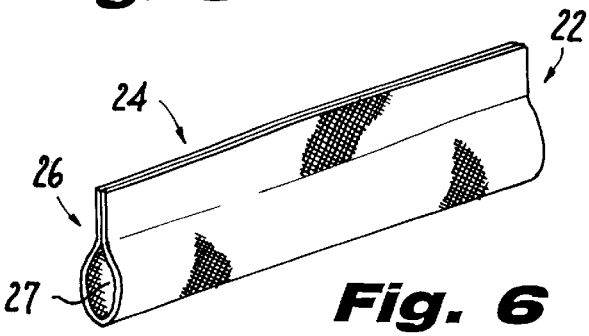
Fig. 6

BETWEEN TOES DRYER

Related applications. This application is a continuation in part of my application Ser. No. 08/867,569 filed Jun. 2, 1997 for "Between Toes Cleaner" for which priority under 35. U.S.C. 120 is claimed, now abandoned.

BACKGROUND OF THE INVENTION

The present invention relates to means to wash, debride, dry and treat the skin between toes.

As people age, skin normally becomes thin and dry, and the toes may be distorted by pressures from tight, high styled shoes and bunions, corns and hammer toes. In addition there may be manifestations of poor health and circulation, arthritis, Diabetes, stroke, etc. All of the foregoing cause toes to deform into substantially irregular square and triangular shapes that nest tightly against one another. This position locks in the moisture of perspiration and bathing as well as the debris of the normal shedding of the skin.

All of the above predisposes the skin to maceration, irritation and tearing, which permits the entry of fungus (athlete's foot), bacterial infections and/or may cause ulcerations. Debridement, gentle washing, thorough gentle drying and the insertion of proper medications are necessary to prevent and/or treat such problems.

As toe conditions vary, so must the kind of materials used in their hygiene. Debriding a dry skin is best done with a soft foam. Washing a macerated toe is best done with a soft soapy gauze. Drying is better done with a soft absorbent material, etc.

To achieve such proper hygiene the toes must be moved and separated as little as possible so as not to stretch and tear the tender skin, especially in the web areas. Often the use of one's fingers to separate toes is enough to cause such harm. The problems of proper hygiene are compounded as those most in need of such care, the elderly, the infirm and the obese, find it difficult and often impossible to see and reach the toes for the delicate necessary care.

A device to achieve care of the area between toes has been attempted. Soft foam pads have been firmly attached to an underlying skeleton formed by two parallel runs originating in a handle. Such device is entirely rigid and the skeletal arms which are inserted between the toes is a rigid plastic, one eighth of an inch square with sharply defined edges. The foam, which extends beyond the skeleton, is wedge shaped, designed to separate the toes and act as a guide for the remainder of the device.

The materials, size and shape of the device cited presents inherent problems that make its use difficult, inappropriate and often impossible. The wedge shaped front end of foam extending beyond the supportive backing of the rigid skeletal is itself too soft and limp to be forced between tightly packed toes. Further, the soft wedge is then squeezed back on to the front of the rigid arms adding its thickness to the one eighth inch arms and the foam already secured there, making penetration between toes impossible without the spreading apart of the toes by the fingers. Further, if penetration is achieved with the spreading apart of the toes, the rigidity of the skeleton does not permit it to bend and change its shape to conform to the bumpy irregular shape of the toes and could, in conjunction with the square shaped edges of the skeletal arms, initiate the irritation of the tender tissues it was meant to prevent.

Thinner plastic arms are precluded because the device would then be too weak to withstand the stresses of use and would break, as plastics do, with sharp edges. Further, use of a thinner gauge of the same plastic would not increase its bendability. If other stronger plastics are used, there would be no increase in bendabilty, and it would still not have the benefits inherent in other materials to be cited in the present invention. Finally, the use of stronger plastics would bring up the price of manufacture. As such a device is designed to be used mainly by older people, most of whom are retired with a restricted income, price is an important factor in their decision of whether they will take advantage of the benefits such a device provides.

Further, it should be noted that the above device is available with only one type of surface adhered to its plastic skeleton. If the use of materials other than soft foam was indicated and desired, an entire complete device would have to be purchased, if it was available.

Further, such devices with other materials attached, such as cloths, felts and the like, extended beyond the support of the skeleton would also be limp and would not ameliorate the problem of introducing the device between the toes. Further, the bunching of such materials, rougher than a soft foam, would increase the probability of doing harm to the skin of the toes.

It has been found that with the use of other materials for the skeleton arms, such as a resilient flexible wire, the area of the skeleton between the toes can be reduced by a factor of twenty five while the danger of breaking under the pressures it would be subjected to would be nil. Further, such a resilient flexible wire could easily change shape and accommodate itself to the various deformities and irregularities of toes. Further, use of such wire, or the like, would easily allow permanent changes in the shape of the skeleton that would permit different materials such as clothes, foams, felts etc., fabricated in the shape of a sleeve, to be easily changed and secured.

The object of this invention is to overcome the above stated deficiencies while including all possible benefits.

SUMMARY OF THE INVENTION

A principal feature of the present invention is the provision of strong, safe, inexpensive and relatively thin and flexible means to safely and gently spread apart toes the minimum distance necessary to permit the entry of means suitable for the debridement, washing, drying and treatment of the areas between toes without the spreading help of the fingers or any other modality.

Another feature of the invention is the incorporation of means to guide the apparatus into the space between the toes.

Another feature of the invention is to provide means to change, remove, replace, easily and quickly, different materials on the basic skeleton of the apparatus.

Another feature of the invention is to provide means that will secure various materials firmly in place in such a manner that they will not to be dislodged by the necessary reciprocating movement of the apparatus between the toes.

Another feature of the invention is to provide a flexible skeleton any part of which can easily bend in any direction to accommodate the irregular shapes of toes.

Another feature of the invention is to provide a material for the skeleton which has rounded surfaces.

DESCRIPTIONS OF THE DRAWINGS

FIG. 1. is a side sectional view of one embodiment with a sleeve of material seated between two projections of the skeleton.

FIG. 2. is a cross cut view at line A—A of FIG. 1 with a sleeve of material fabricated in one continuous piece, in place on the skeleton.

FIG. 3. is a cross cut view at line A—A of FIG. 1 with a sleeve of material fabricated by the joining of two sides, in place on the skeleton.

FIG. 4. is a sectional view of another embodiment, with a sleeve of material over a forward projection of the skeleton.

FIG. 5. is a plan view from above of the other embodiment with a sleeve of material over a forward projection and the other end of the sleeve secured in a clip attached to the handle.

FIG. 6. is an oblique view of a sleeve to fit the other embodiment, showing the partially closed front end.

DESCRIPTION OF ONE EMBODIMENT

FIG. 1 shows the skeleton 1 bent at area 10 to give rise to the arms 8 and 9 which are secured to the handle 3 at area 6. Arm 8 has projections 11 and 12. Sleeve 4 is in position around arms 8 and 9 and between projections 11 and 12.

FIG. 2 shows a sleeve 4, fabricated in one continuous piece, is in place over the arms 8 and 9.

FIG. 3 shows a sleeve 4, fabricated by the joining of two sides 13, is in place over the arms 8 and 9.

Sleeve 4 may be fabricated in a continuous circle, as shown in FIG. 2, or may be fabricated by having two sides joined by means of stitching the two sides 13 or by the use of adhesives or any other manner. Such joining would add stiffness and shape to soft materials. Such a joined area of sleeves would be used facing away from the weak web areas of toes.

A squeezing pressure on the front area of 10 will bring arms 8 and 9 closer together so that sleeve 4 can be slipped over projection 11 and removed. A similar squeezing pressure permits another sleeve 4 to be slipped into place over projection 11 to rest between projections 11 and 12. The arms 8 and 9 as well as the projections 11 and 12 return to their position upon release of the squeezing pressure because of the resiliency of the wire of the skeleton 1.

In use, area 10 provides a thin guide to entry between toes. Further inserting pressure pushes the sleeve 4 between the toes. Then, a back and forward motion acts to either deride, wash, dry or deposit medications between the toes, depending on kind of sleeve material used and the needs of the area between the toes. The projections 11, and 12, keep the sleeve 4 in place during such motion. The resiliency and the bendability of the wire used to form the skeleton permits the skeleton to mold and bend to accommodate any irregular shape of the toes so as not to injure the toes.

DESCRIPTION OF ANOTHER EMBODIMENT

In FIG. 4 two items are given different numbers than similar items had in FIG. 1 and FIG. 2 to clarify their different characteristics. The sleeve of material is given the number 24 to distinguish it from the sleeve 4 of the First Embodiment and one arm is numbered 18 to distinguish it from arm 8 of the First Embodiment. Skeleton 1 extends back to attach securely to the handle 3 by any convenient means. The handle 3 has an attached clip 23 to grasp end 22 of the sleeve 24. The front end 25 of the sleeve 24, is divided into two parts. Part 26 is closed. Part 27 is open.

In use, the open end 22 of sleeve 24 is slipped over the area 10, pulled tightly and the back end 22 is secured by the clip 23.

Clip 23, in this instance spring loaded, has two extensions 28, 29, between which the back end 22 of the sleeve 24 is grasped and secured. Other means may be used to grasp and secure the back end 22 of the sleeve 24.

FIG. 5 Is a view from above showing the extensions 28, 29 of the clip 23 securing the open end 22 of the sleeve 24. Area 10 of the skeleton 1 projects through the open end 27 of the sleeve 24 to secure that end. The other end of sleeve 24, 22, is secured by clip 23.

It has been found that resilient flexible wires ranging in gauges generally about 0.025 to 0.047 and round in cross section, work well in such an apparatus.

The foregoing detailed description is given for clearness of understanding only and no unnecessary limitation should be understood therefrom, as modifications will be obvious to those skilled in the art.

I claim:

1. Apparatus for treating the skin between the toes comprising a handle, an elongated wire frame extending from said handle and bent at distal end thereby defining an upper and lower run, said frame being flexible and resilient to the irregular shape of the toes, a sleeve having an opening at each end mounted over said frame such that the openings are opposed to each other and maintained by the distension of the upper and lower runs from each other, said sleeve being made of material capable of performing at least one of the following: debriding, washing, drying and medicating the skin, and means for removable securing said sleeve on said frame.

2. The apparatus of claim 1, where said material is one of the following materials such as gauze, cloths, felts, foams and the like.

3. The apparatus of claim 1, where said sleeve is fabricated as a seamless tube.

4. The apparatus of claim 1, where said sleeve is of a sheet formed as a tube and seamed.

5. The apparatus of claim 1, wherein the opening at are of said ends is partially closed.

6. The apparatus of claim 1, where means for removable securing said sleeve is attached to said handle.

7. Apparatus for treating the skin between the toes comprising a handle, an elongated skeletal frame extending from said handle formed of bent wire having an upper and lower arm, said frame being flexible and resilient for accommodating irregular shapes of the toes, a sleeve mantel over the frame in position and maintained by the distension of the upper and lower arms from each other, said sleeve being made of a fabric material capable of performing at least one of the following: debriding, washing, drying and medicating the skin, and means for removable securing said sleeve on said frame comprising spaced projections along at least one arm.

8. The apparatus of claim 7, where said sleeve is of a size to encircle said arms and be positioned between said projections.

9. The apparatus of claim 7, wherein said bent wire has a small enough diameter for fitting between said toes with minimal separation thereof, wherein the distal end of said frame forms a guide for entry between the toes.

* * * * *

UNITED STATES PATENT AND TRADEMARK OFFICE

CERTIFICATE OF CORRECTION

PATENT NO. : 5,970,565
DATED : October 26, 1999
INVENTOR(S) : Benjamin Zubner

It is certified that error appears in the above-identified patent and that said Letters Patent is hereby corrected as shown below:

Column 4,
Line 23, between "at" and "distal" insert -- a --
Line 27, between "maintained" and "by" insert -- in position --
Line 40, change "are" to -- one --
Line 48, change "mantel" to -- mounted --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*